US007760228B2

(12) United States Patent
Mamiya

(10) Patent No.: US 7,760,228 B2
(45) Date of Patent: Jul. 20, 2010

(54) LIGHT SCANNING APPARATUS AND IMAGE FORMING APPARATUS

(75) Inventor: Toshiharu Mamiya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 450 days.

(21) Appl. No.: 11/802,608

(22) Filed: May 24, 2007

(65) Prior Publication Data

US 2007/0273748 A1 Nov. 29, 2007

(30) Foreign Application Priority Data

May 26, 2006 (JP) ..... 2006-147381

(51) Int. Cl.
*B41J 15/14* (2006.01)
*B41J 27/00* (2006.01)

(52) U.S. Cl. ..... 347/257; 347/242

(58) Field of Classification Search ..... 347/231, 347/241–245, 256–261, 263
See application file for complete search history.

(56) References Cited

U.S. PATENT DOCUMENTS 6,280,443 B1 * 8/2001 Gu et al. ..... 606/264
6,580,443 B2 * 6/2003 Yamaguchi et al. ..... 347/115
6,888,645 B1 * 5/2005 Fujimoto et al. ..... 358/1.9

FOREIGN PATENT DOCUMENTS

JP 62094814 A * 5/1987
JP 07199107 A * 8/1995
JP 10-206775 8/1998

* cited by examiner

*Primary Examiner*—Hai C Pham
(74) *Attorney, Agent, or Firm*—Fitzpatrick, Cella, Harper & Scinto

(57) ABSTRACT

A light scanning apparatus has a base member, a first engagement portion that engages with a bearing member having a bearing portion of a rotary shaft that rotates a rotational polygon mirror to thereby position the bearing member, a second engagement portion that engages with a bearing member having a bearing portion of a rotary shaft that rotates a rotational polygon mirror to thereby position the bearing member, and a positioning portion in which the first engagement portion and the second engagement portion are integrally formed, the positioning portion being provided on the base member. With this structure, a common base member can be used in optical units, and even when rotational polygon mirrors are supported on different surfaces of the base members of optical units, a difference in precision of support can be made small.

8 Claims, 13 Drawing Sheets

LIGHT SCANNING APPARATUS AND IMAGE FORMING APPARATUS

BACKGROUND OF THE INVENTION

1. Field of the Invention

The present invention relates to a light scanning apparatus that deflects a laser beam emitted from a laser unit and focuses it onto a plurality of photosensitive members and an image forming apparatus, such as a color copying machine or a color printer, that uses such a light scanning apparatus.

2. Description of the Related Art

Conventional image forming apparatuses of the above described type form images using four color toners of yellow (Y), magenta (M), cyan (C) and black (Bk), and have photosensitive members, exposure units and developing units for the respective colors.

A conventional apparatus will be described by way of example with reference to FIGS. 10 and 11. FIG. 10 illustrates an image forming apparatus that prints color images. The image forming apparatus has independent image bearing members (which will be referred to as photosensitive drums, hereinafter) for the respective colors of yellow, magenta, cyan and black. The photosensitive drum is a conductor member on which a photosensitive layer is applied. An electrostatic latent image is formed on the photosensitive drum by a laser beam emitted from a scanning exposure apparatus. The scanning exposure apparatus 51 emits a laser beam based on image information supplied from an image reading apparatus, a personal computer or the like that is not shown in the drawings. A developer 52 forms a toner image on the photosensitive drum using toner that has been triboelectrically charged. The toner image on the photosensitive drum is transferred to a transfer sheet by an intermediate transfer belt 53. Sheets on which toner images are to be formed are stored in a sheet feeding cassette 54. The toner image transferred on the sheet is fixed by a fixing device 55. The transfer sheet having a fixed image is delivered onto a discharge tray 56. Toner remaining on the photosensitive drum is cleaned by a cleaner 57.

In the image forming process, the surface of the photosensitive drum is irradiated with a beam emitted as laser radiation from the scanning exposure apparatus based on image information, whereby an electrostatic latent image is formed on the photosensitive drum that bas been charged by a charger. Then, in the interior of the developer, triboelectrically charged toner adheres to the electrostatic latent image, so that a toner image is formed on the photosensitive drum. The toner image is transferred from the photosensitive drum onto an intermediate transfer belt, and then further transferred onto a sheet conveyed from the sheet feeding cassette provided in the lower portion of the apparatus body. Thus, an image is formed on the sheet. The toner of the image having been transferred on the sheet is fixed by the fixing device, and the sheet is delivered onto the discharge tray.

FIG. 11 illustrates an image forming portion of the apparatus shown in FIG. 10. The image forming portion has a symmetrical structure, and reference signs are assigned only to the elements on the right side portion in the drawing. The scanning exposure apparatus shown in FIG. 11 has a rotational polygon mirror 58, fθ lenses 59, 60 and a dust-proof glass 62. A laser beam emitted according to image information is deflected by the polygon mirror 58. The deflected laser beam is directed toward the photosensitive drum by being reflected with a plurality of turn back mirrors 61*a*, 61*b*, 61*c* and 61*d* through the fθ lens 59, 60. The directed laser beam is focused onto the photosensitive drum as a spot. The photosensitive drum is scanned with the focused laser beam at a constant speed by the effect of the fθ lens 59, 60. The laser beam reflected by the turn back mirrors 61*a* to 61*d* passes through the dust-proof glass 62 for protecting the scanning exposure apparatus from dust to form an electrostatic latent image on the photosensitive drum. With a decrease in the size of the body of the apparatus, the position at which the scanning exposure apparatus is provided has been changed to a position near the photosensitive drums unlike with conventional arrangements in which the scanning exposure apparatus is positioned remote from the drums. In association with this, use is made of a system in which four photosensitive drums are irradiated with laser beams by means of a single polygon motor unit as shown in FIG. 11. This system includes two scanning groups with which a plurality of laser beams are directed to opposed surfaces of the polygon mirror respectively. To make the unit compact, a plurality of turn back mirrors are used. To focus laser beams traveling on two different optical paths onto the corresponding photosensitive drums respectively, two lenses that are cemented to each other or a mold lens having two optical paths formed by integral molding is used. Since this kind of optical system having two optical paths needs to have a deflection surface that deflects and scans the laser beams of the respective optical paths, a polygon mirror having a tall reflection surfaces or a polygon mirror having a two-tier structure is used.

Although it is possible to make the apparatus small by irradiating the four photosensitive drums by one scanning exposure apparatus as per the above, the reduction in the lateral size of the apparatus and the area occupied by the apparatus has limits, so long as the four photosensitive drums are arranged in series.

In view of this, four photosensitive drums 100*a* to 100*d* may be arranged on different sides of an intermediate transfer belt 102 as shown in FIG. 12. By this arrangement, the lateral size of the apparatus and the area occupied by the apparatus can be reduced. In this arrangement, the four photosensitive drums are irradiated by four scanning exposure apparatuses 101*a* to 101*d* individually. The four scanning exposure apparatuses may be of the same type to simplify the manufacturing process. However, in contrast to the three scanning exposure apparatuses 101*a* to 101*c* that are arranged below the intermediate transfer belt 102, the scanning exposure apparatus 101*d* arranged above the intermediate transfer belt 102 is mounted upside down. Accordingly, a motor M for driving the polygon mirror provided in the interior of the scanning optical system is also used in the upside-down state. The bearing of the motor generally used is a dynamic pressure bearing using oil or air. When such bearings are used in the upside-down state, there arises the problem that they will be displaced along the axial direction due to the weight of the rotor and polygon mirror. In the case of bearings using oil, in particular, oil can flow out to cause serious problems such as deterioration in the durability of the motor and/or smear of the mirror.

As a countermeasure to the above problem, in Japanese Patent Application Laid-Open No. 10-206775, it is disclosed that an arrangement in which the motor may be mounted either on the top or bottom of the optical device box in a vertical orientation.

In this arrangement of the apparatus as disclosed, to reverse the direction of scanning with the laser beam on a photosensitive drum, a scanning exposure apparatus in the image forming apparatus is mounted upside down, but the orientation of the motor is not upside down.

As shown in FIGS. 13 to 15, a laser unit 72 is mounted on a side wall of the optical device box 71. In the optical device box 71, the laser beam L3 emitted from the laser unit 72 is converged by a cylindrical lens 73 into a linear shape and thereafter deflected by a polygon mirror 74 fixed on a motor 75 and rotated at high speed. The surface of a photosensitive drum 78 is scanned to be exposed with the laser beam L4 deflected by the polygon mirror 74 and having passed through the fθ lenses 76, 77 in the direction indicated by arrow C. Thus, the surface of the photosensitive drum 78 is scanning exposed. On the path of a part of the laser beam L3 deflected by the polygon mirror 74 to scan the photosensitive drum 78, a light sensor 79 for generating a synchronization signal is provided. The optical device box 71 is mounted on the mount portions 80, 81 on the image forming apparatus by means of fixing screws 82, 83.

On the optical device box 71 are provided positioning pins 71*a*, 71*b* for positioning the motor 75 and screw holes corresponding to the positioning pins 71*a*, 71*b* for the use of fixing the motor 75. On the base plate portion 75*a* of the motor 75 are provided positioning holes 75*b*, 75*c* through which the positioning pins 71*a*, 71*b* are to be inserted and mounting projections 75*d*, 75*e*, 75*f* associated with the screw holes. The positioning holes 75*b*, 75*c* and one mounting projection 75*d* are arranged on a horizontal straight line that passes through the rotation center of the polygon mirror 74. The other mounting projections 75*e*, 75*f* are arranged at symmetrical positions with respect to the aforementioned straight line. The base plate portion 75*a* of the motor 75 is fixed to the optical device box 71 by fixing screws 84, 85, 86.

As shown in FIG. 14, the positioning holes 75*b*, 75*c* and the mounting projections 75*d*, 75*e*, 75*f* are adapted in such a way that even if the optical device box 71 is turned upside down, the motor 75 need not be turned upside down, namely the motor 75 can be kept in the original orientation with the polygon mirror 74 facing upward. In the case where the optical device box 71 is mounted upside down, the scanning direction C can be reversed by rotating the motor 75 in the reverse direction by an electric circuit.

In connection with the above, while in the case illustrated in FIG. 14, the shaft portion of the motor is supported by the frame of the optical unit, in the case illustrated in FIG. 15, the shaft portion of the motor is supported only by the electric board, and the precision of support differs between these cases. When the scanning exposure apparatus is used in the image forming apparatus as illustrated in FIG. 12, such a difference in the precision of support leads to an increase in color misregistration between the toner image transferred from the photosensitive drum 100*d* onto the intermediate transfer belt 102 and the toner images transferred from the other photosensitive drums onto the intermediate transfer belt 102.

SUMMARY OF THE INVENTION

A purpose of the present invention is to enable to use a common type of base members in optical units, and to enable to reduce differences in the degree of precision in supporting rotational polygon mirrors on the base members of the optical units, even when the rotational polygon mirrors are supported on different surfaces of the base members.

Another purpose of the present invention is to provide a light scanning apparatus including a frame for supporting a rotational polygon mirror, a first engagement portion which engages with a bearing member having a bearing portion of a rotary shaft that rotates a rotational polygon mirror, said first engagement portion being provided on said frame to position the bearing member with regard to said frame, a second engagement portion which engages with a bearing member having a bearing portion of a rotary shaft that rotates a rotational polygon mirror, said second engagement portion being provided to position the bearing member with regard to said frame at a side opposite to a side at which said first engagement portion is provided.

A further purpose of the present invention will become apparent from the following description of exemplary embodiments with reference to the attached drawings.

DESCRIPTION OF THE EMBODIMENTS

In the following, an exemplary embodiment of the present invention will be described.

Figure 9:
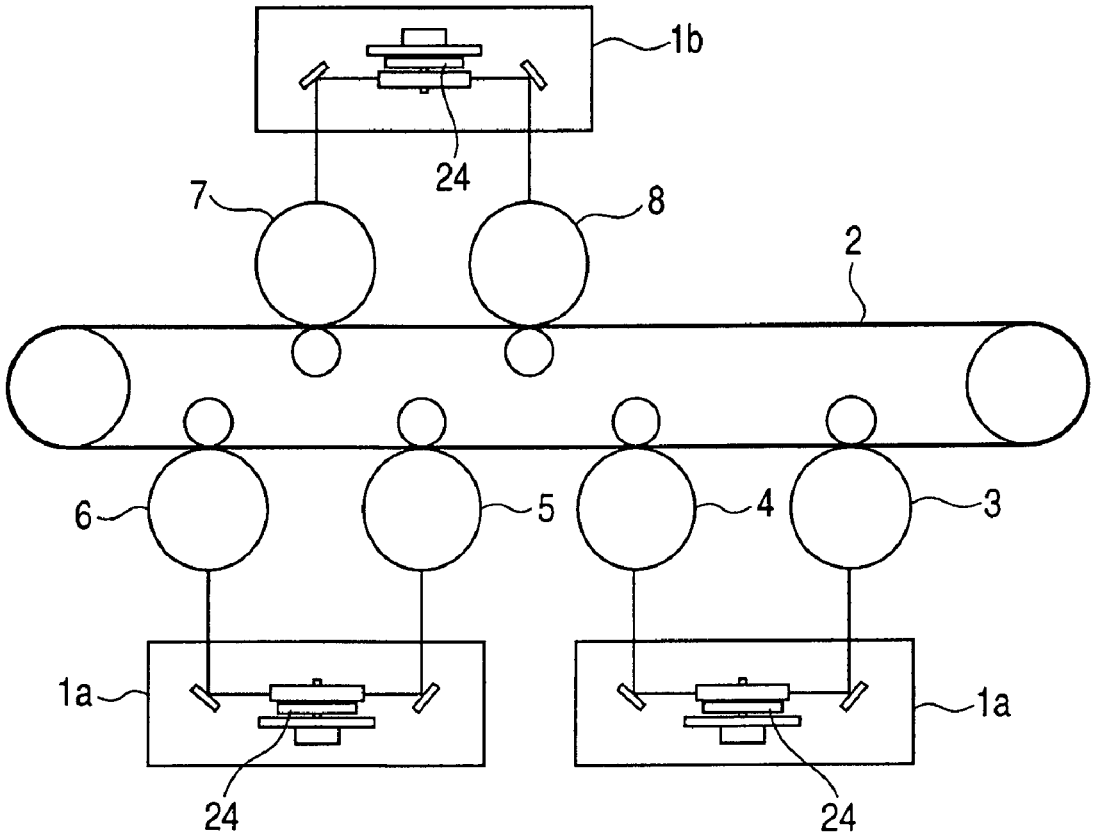
FIG. 9 illustrates an image forming apparatus to which the present invention is applied.
Figure 10:
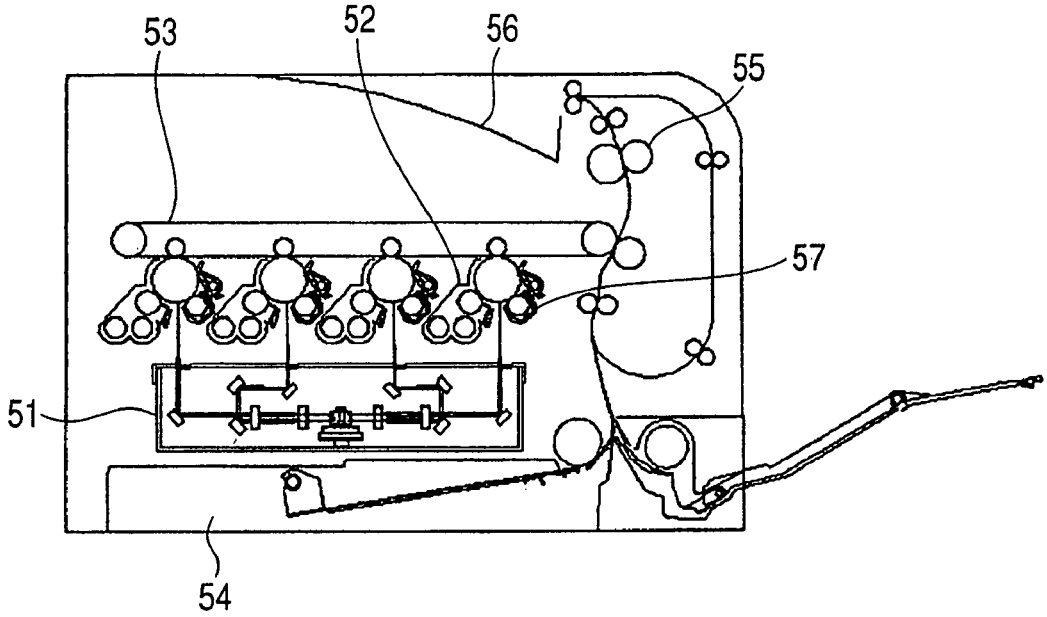
FIG. 10 illustrates the structure of the image forming apparatus.
Figure 11:
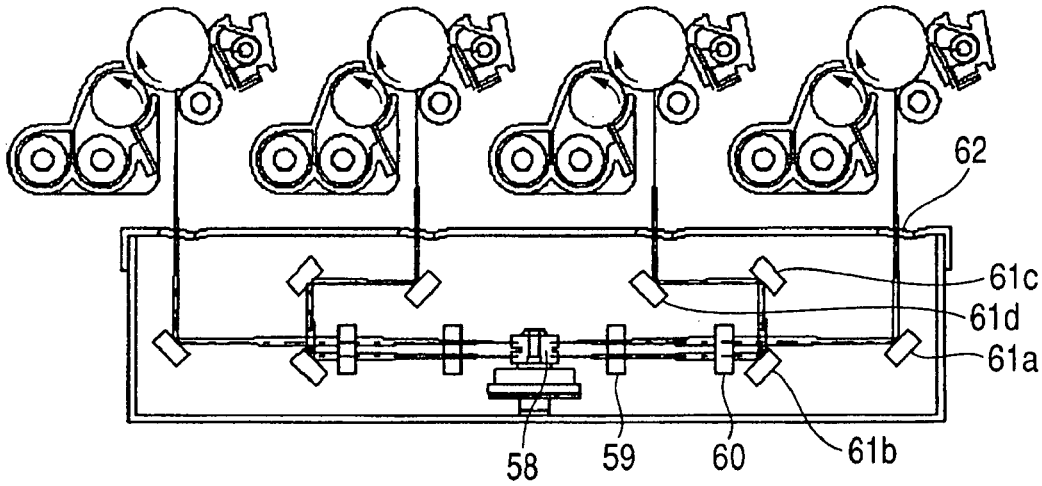
FIG. 11 illustrates the scanning exposure apparatuses and relevant portions in FIG. 10.
Figure 12:
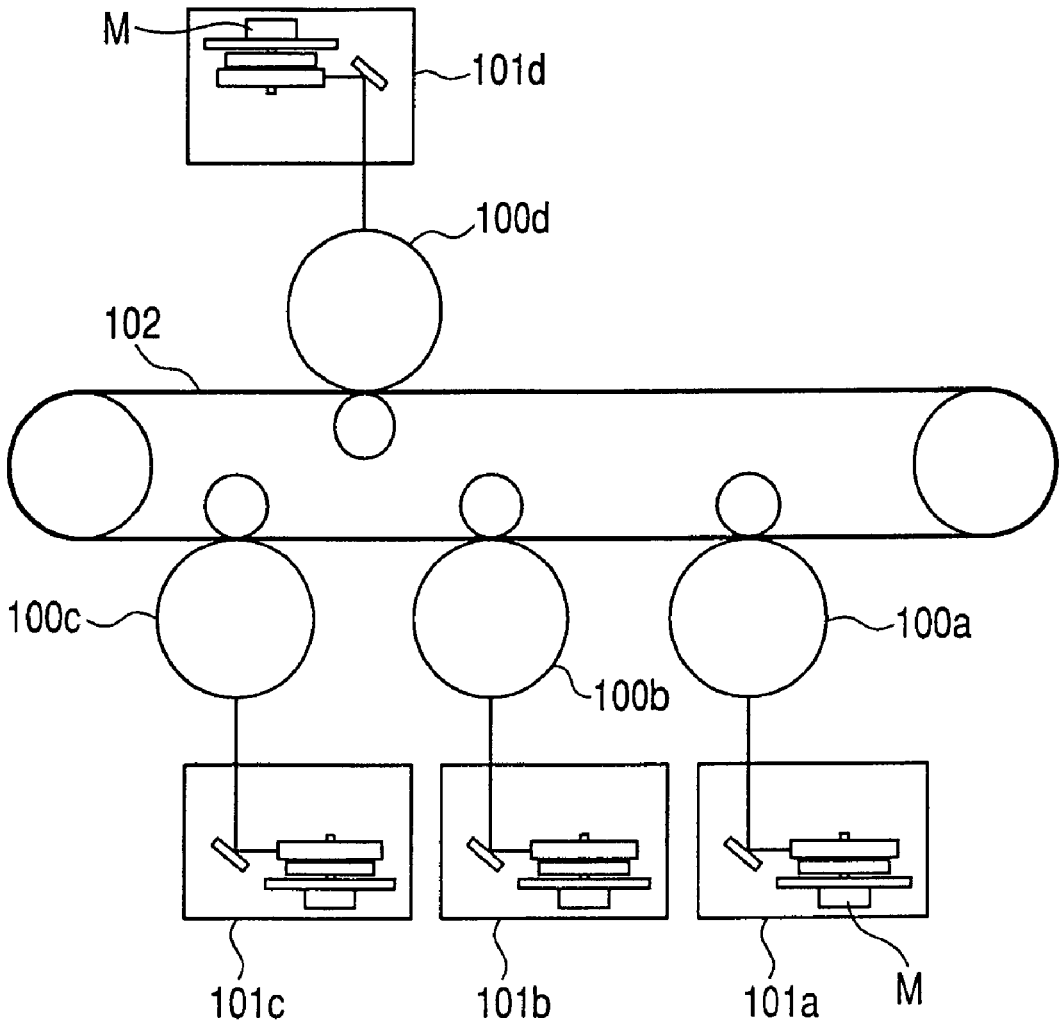
FIG. 12 schematically illustrates the structure of scanning exposure apparatuses and relevant portions.
Figure 13:
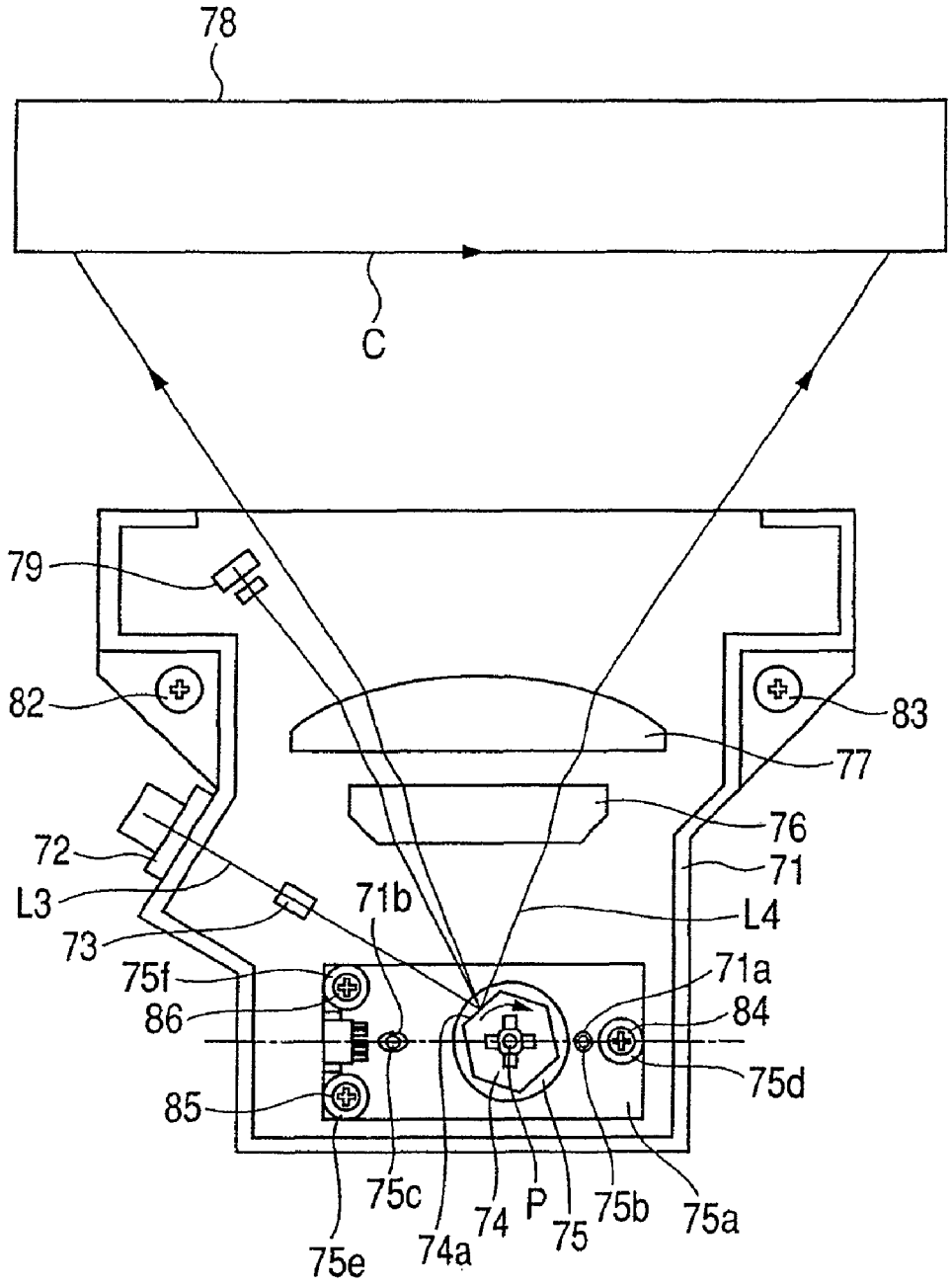
(PRIOR ART) FIG. 13
FIG. 13 illustrates a conventional scanning exposure apparatus.
Figure 14:
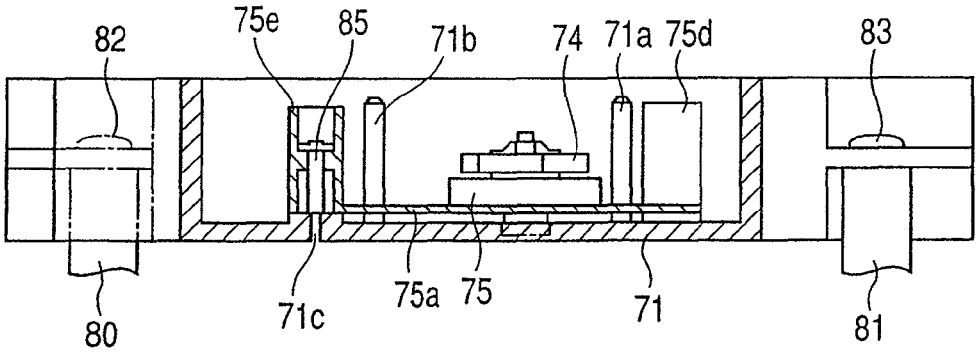
(PRIOR ART) FIG. 14
FIG. 14 is a cross sectional view of the scanning exposure apparatus shown in FIG. 13.
Figure 15:
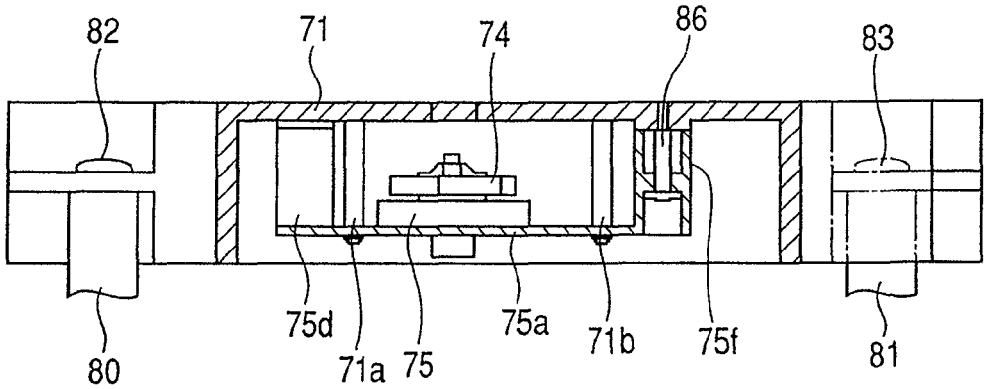
(PRIOR ART) FIG. 15
FIG. 15 illustrates another type of conventional scanning exposure apparatus.

FIG. 9 illustrates scanning exposure apparatuses and portions relevant thereto in an image forming apparatus according to an embodiment. In FIG. 9, a plurality of photosensitive drums 3 to 8 serving as image bearing members are provided in the vicinity of the scanning exposure apparatuses. Among the photosensitive drums, four photosensitive drums 3 to 8 are respectively associated with normally used colors, namely yellow (Y), magenta (M), cyan (C) and black (Bk) The other photosensitive drums 7 and 8 are associated with special colors that are added to enhance color reproduction. Among these additional drums, one photosensitive drum 7 is adapted to form a toner image with light magenta toner that has the same hue as and higher brightness than the magenta toner, and the other photosensitive drum 8 is adapted to form a toner image with light cyan toner that has the same hue as and higher brightness than the cyan toner. In this embodiment, image forming units including the photosensitive drums 3 to 8 are provided.

Near the plurality of photosensitive drums 3 to 8, there is provided an intermediate transfer belt 61, which is a belt member that transfers toner images formed on the photosensitive drums 3 to 8 onto a transfer sheet. The image forming units in this embodiment have the same structure except for the colors of the toners. Here, a description will be made of the image forming unit for yellow. In the vicinity of the photosensitive drum 3 are provided a charging member for charging the photosensitive drum 3, a developing unit for forming a toner image from an electrostatic latent image formed by exposure, a primary transfer member for transferring the toner image onto the intermediate transfer belt and a cleaning unit for cleaning residual toner. The charging member, the developing unit, the primary transfer member and the cleaning unit as described above are provided in each of the image forming units for respective colors in the same manner. Single color toner images formed in the respective units are superimposed on the intermediate transfer belt, and then they are transferred onto a recording material by a secondary transfer member. The toner images thus transferred are fixed by heat by a fixing unit. The intermediate transfer belt used in this embodiment is stretched between tension members. Details of the scanning exposure apparatus performing image exposure will be described later. To prevent an increase in the lateral size of the image forming apparatus and an increase in the area occupied by the image forming apparatus, two photosensitive drums 7 and 8 are provided on the side of the intermediate transfer belt, which serves as an intermediate transfer member, different from the side on which the other photosensitive drums 3 to 6 are provided. Specifically, the two photosensitive drums 7 and 8 are provided on the upper side with respect to the vertical direction and the other photosensitive drums 3 to 6 are provided on the lower side. To expose the photosensitive drums 3 to 6 disposed on the lower side, two scanning exposure apparatuses la are provided below the photosensitive drums 3 to 6. On the other hand, a scanning exposure apparatus 1*b* for exposing the two photosensitive drums 7 and 8 disposed on the upper side is provided above the photosensitive drums 7 and 8.

Embodiment 1

In the following, an embodiment will be described with reference to drawings.

FIGS. 1 to 4 show one of the scanning exposure apparatuses 1*a* in FIG. 9. In this embodiment, the scanning exposure apparatus is an optical unit that can be detachably mounted on an image forming apparatus.

Figure 4:
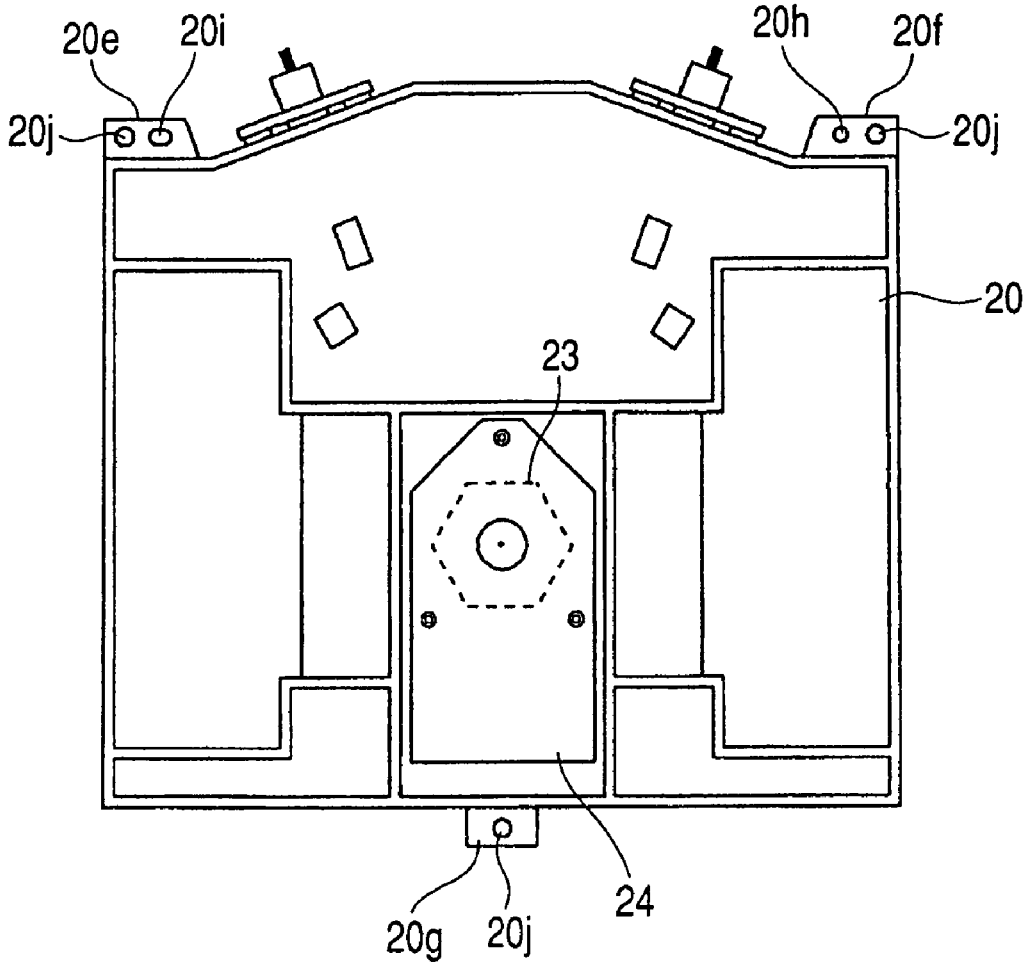
FIG. 4 is a bottom view of the scanning exposure apparatus shown in FIG. 1.

Referring to FIG. 4, an optical device box 20 has three body mount portions 20*e*, 20*f* and 20*g* provided on the upper and lower portions thereof. The body mount portions 20*e*, 20*f* and 20*g* have a circular hole 20*h* for positioning, an elongated hole 20*j* and three screw holes 20*j*. The three body mount portions are positioned by positioning pins (not shown) provided on the apparatus body and secured by screws, whereby the scanning exposure apparatus is fixedly mounted on the image forming apparatus. Here, reference is made to FIGS. 1 and 2. Laser units 21*a* and 21*b* for irradiating two photosensitive drums are mounted on a side wall of the optical device box 20. Each laser unit 21*a*, 21*b* has a semiconductor laser LD serving as a light source and a collimator lens CL that changes the laser beam into a parallel beam. Cylindrical lenses 22*a* and 22*b* are adapted to focus the laser beams emitted from the laser units 21*a* and 21*b* in linear shapes on a polygon mirror 23 that functions as a rotational polygon mirror. The polygon mirror 23 that functions as a rotational polygon mirror is fixed on the rotor of a motor 24 serving as a drive unit and rotates at high speed to thereby deflect the laser beams to scan photosensitive drums. FE lenses 25*a*, 26*a* and 25*b*, 26*b* serving as imaging members are provided to focus the laser beams emitted from the laser units 21*a* and 21*b* and deflected by the polygon mirror 23 onto two photosensitive members to thereby scan and expose the photosensitive members at a constant speed. The laser beams having passed through the fθ lenses are guided by turn back mirrors 27*a* and 27*b* respectively toward photosensitive drums provided above the scanning exposure apparatus. Light sensors 29*a* and 29*b* for controlling the timing of image writing are provided. A part of the laser beam deflected by the polygon mirror 23 is focused onto the light sensor 29*a*, 29*b* by a lens 28*a*, 28*b*. In the case where the polygon mirror 23 rotates clockwise in FIG. 2, the timing of image writing on the two photosensitive drums is controlled by detecting the laser beam from the laser unit 21*a* by means of the light sensor 29*a*. On the other hand in the case where the polygon mirror 23 rotates anticlockwise, the timing of image writing is controlled by detecting the laser beam from the laser unit 21*b* by means of the light sensor 29*b*.

Figure 3A:
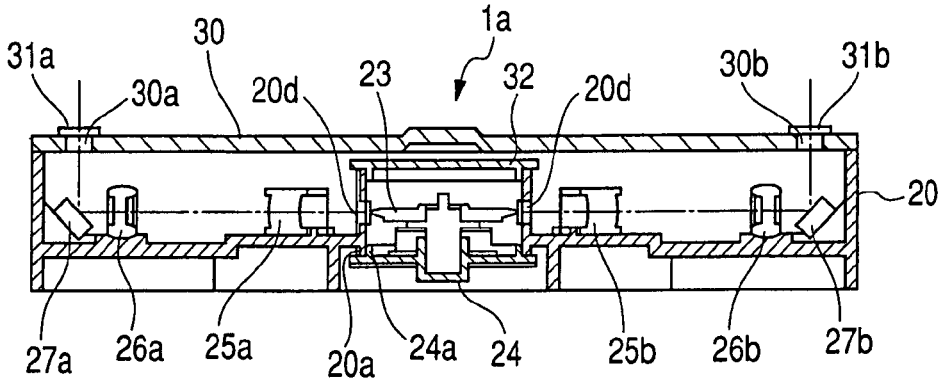
FIG. 3A is a cross sectional view of the scanning exposure apparatus shown in FIG. 1.
Figure 3B:
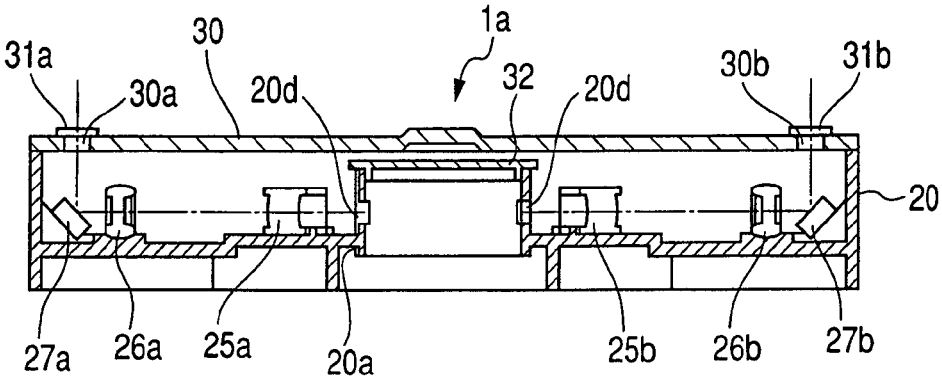
FIG. 3B is a cross sectional view of an optical device box of the scanning exposure apparatus shown in FIG. 1.
Figure 3C:
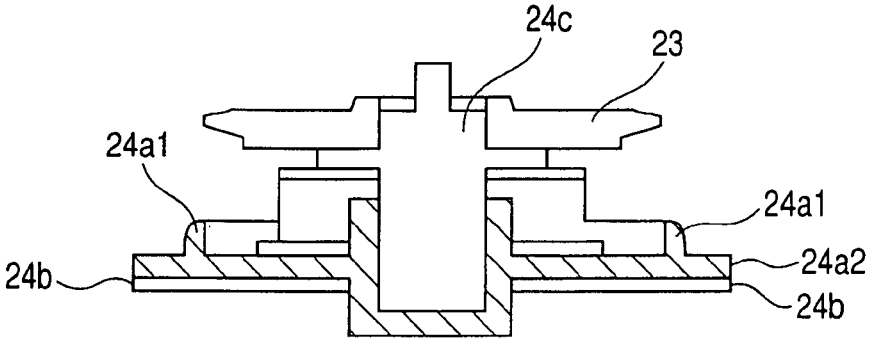
FIG. 3C is a cross sectional view of a motor on which a polygon mirror is attached in the scanning exposure apparatus shown in FIG. 1.

As illustrated in FIGS. 3A, 3B and 3C, a lid member 30 seals the interior of the optical device box 20. The openings 30*a* and 30*b* are provided on the lid member 30 through which the laser beams guided by the turn back mirrors 27*a* and 27*b* toward the photosensitive drums exit. The openings 30*a* and 30*b* are sealed by dust-proof glasses 31*a* and 31*b*. Referring to the vertical orientation of the image forming apparatus, the surface having the lid 30 is facing upward in the image forming apparatus, and the surface opposite thereto is facing downward in the image forming apparatus and constitutes the bottom of the optical device box 20. A cap 32 has a structure for mounting on the optical device box 20 similar to that of the motor 24, and the cap 32 is attached to three motor mount portions 20*c* provided on the inner side of the optical device box 20.

Figure 7:
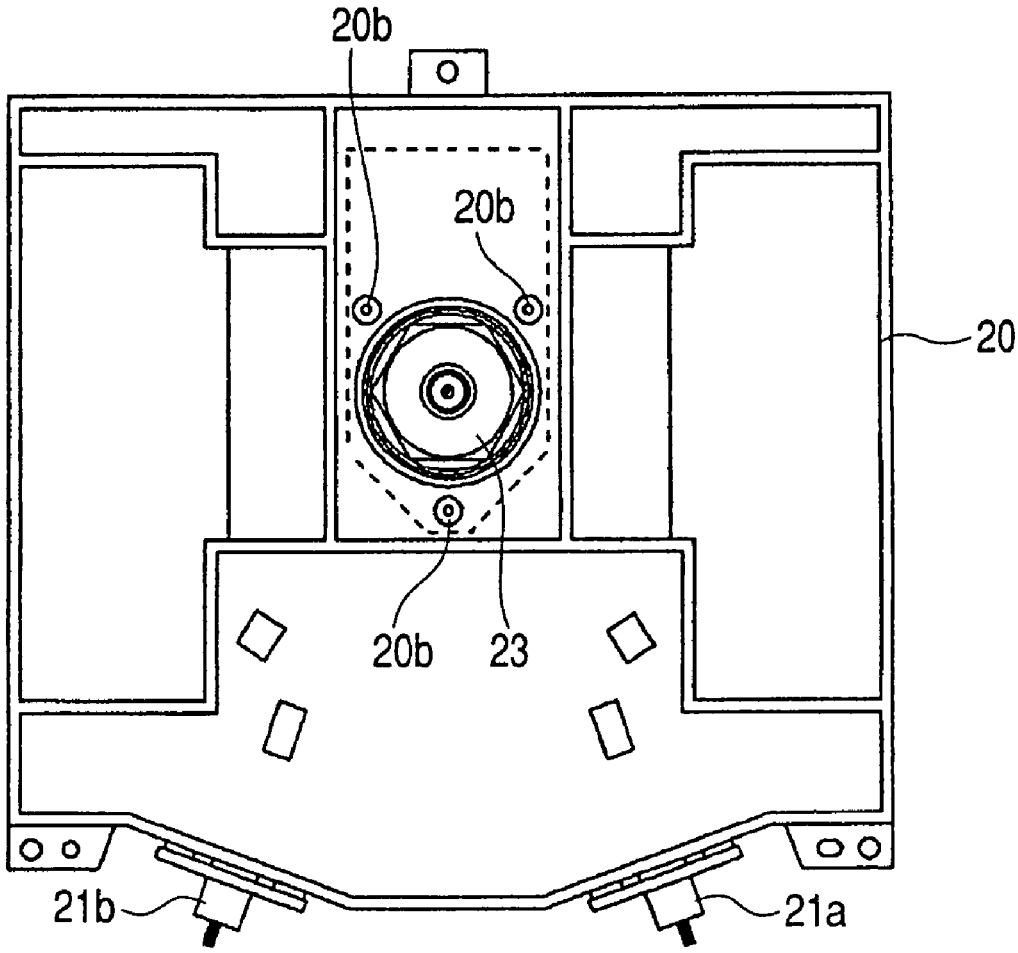
FIG. 7 is a bottom view of the scanning exposure apparatus shown in FIG. 1.

In FIGS. 3A, 3B and 3C, the motor 24 is fixed to three motor mount portions 20*b* (first mount portions) provided on the outer side of the optical device box 20 from the downward (first direction) of the optical device box 20 (see FIG. 7). When the motor 24 is fixed, the outer circumference of a circular positioning portion (first engagement portion) 24*a*1 that is provided on the stator of the motor 24 and coaxial with the rotary shaft of the motor 24 fits or engages with the inner circumference of a cylindrical positioning portion 20*a* serving as a support portion provided on the optical device box 20, whereby the polygon mirror 23 attached on the rotor of the motor 24 is positioned. The circular positioning portion 24*a*1 of the motor 24 may be formed integrally with a bearing portion of the stator to constitute a bearing member. Thus, the motor 24 and the polygon mirror 23 can be positioned relative to the optical device box 20 with high precision.

As will be seen from FIG. 3A, optical components such as lenses and mirrors are supported on the base member of the optical apparatus that constitutes the base of the optical device box 20. The optical components are provided on the same side of the base member as the cylindrical positioning portion 20*a*. In this embodiment, the base member of the optical apparatus serves as an optical frame.

Here, a description will be made of the motor 24 with reference to FIG. 3C. The rotor 24*c* is supported by a bearing member (stator) 24*a*2 having a bearing portion of the rotor

24*c* or the driving shaft. The polygon mirror 23 rotates with the rotation of the rotor 24*c*. The stator 24*a*2 has the positioning portion 24*a*1 for positioning the polygon mirror 23 relative to the optical device box 20. The positioning portion 24*a*2 is molded integrally with the bearing portion. On the lower portion of the stator 24*a*2 is attached an electric board 24*b* for energizing the motor 24 to rotate the rotor 24*c*. The circular positioning portion 24*a*1 of the motor 24 may be formed integrally with the bearing portion of the stator to constitute the bearing member. Thus, the motor 24 and the polygon mirror 23 can be positioned relative to the optical device box 20 with high precision. The positioning portion 24*a*1 is circular in shape when seen from above.

The motor is attached to the positioning portion provided on the base member shown in FIG. 3B. In this embodiment, when the motor 24 is attached to the optical device box 20, the polygon mirror 23 side of the motor 24 is first inserted into the positioning portion 24*a*1. Accordingly, the outer diameter of the positioning portion 24*a*1 is designed to be larger than the rotational diameter of the polygon mirror 23. With this structure, the drive axis of the motor 24 and the center axis of the positioning portion 24*a*1 are substantially aligned with each other.

FIG. 3A illustrates the state in which the motor 24 has been attached to the optical device box 20.

When this optical device box 20 is mounted in the image forming apparatus, the rotational polygon mirror 23 can be disposed above the motor 24 with respect to the vertical direction in the image forming apparatus.

In the surrounding of the polygon mirror 23, there is the cylindrical positioning portion 20*a* provided on the optical device box 20. Nevertheless, the polygon mirror 23 and the rotor 24*c* of the motor 24 will not interfere with the positioning portion 20*a* when they rotate, since the inner diameter of the positioning portion 20*a* is designed to be larger than the diameter of the circumscribed circle of the polygon mirror 23 and the outer diameter of the rotor 24*c*. The cylindrical positioning portion 20*a* of the optical device box 20 has two apertures 20*d* for allowing the laser beams coming from the laser units 21*a* and 21*b* and the laser beams deflected and scanned by the polygon mirror 23 to pass therethrough.

Figure 5:
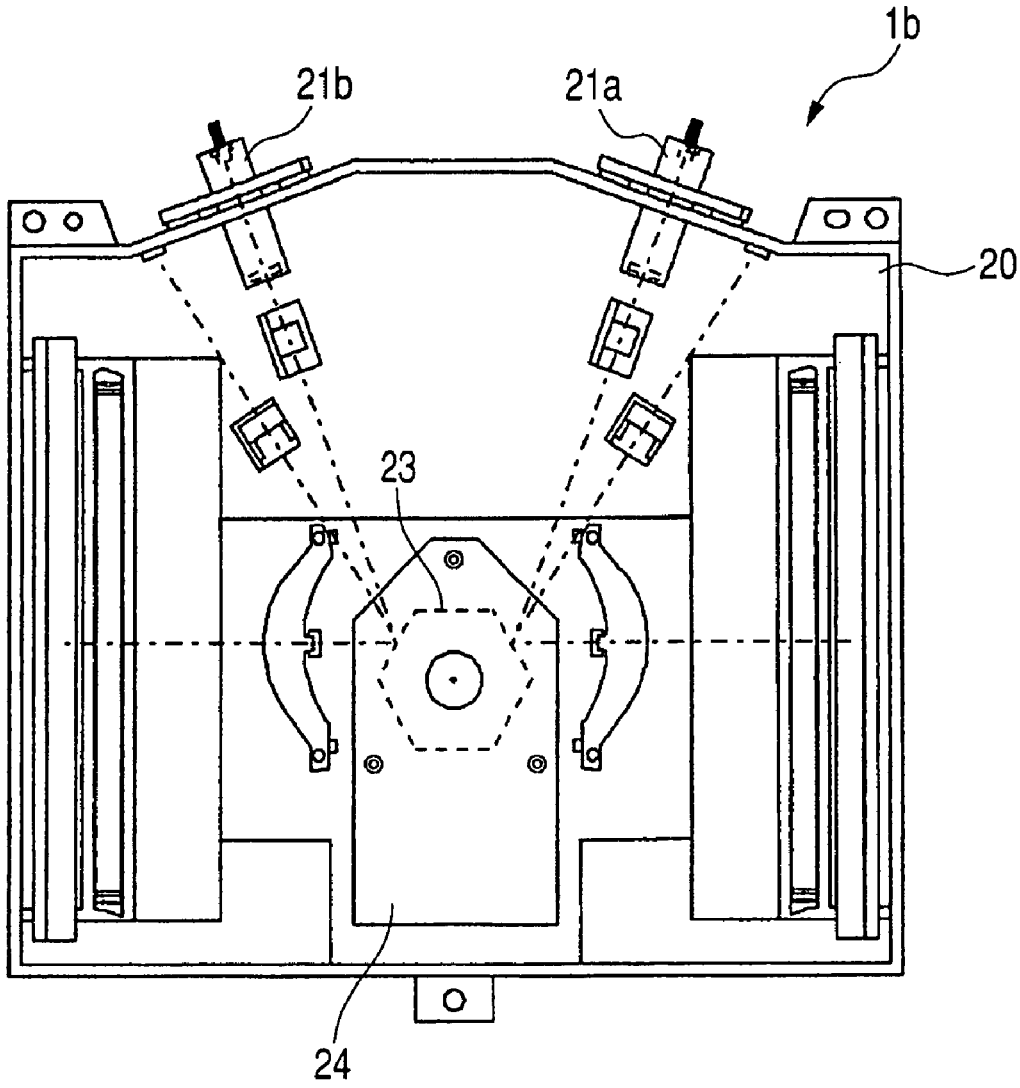
FIG. 5 is a top view illustrating another state of the scanning exposure apparatus to which the present invention is applied.

In the following, a description will be made of the scanning exposure apparatus 1*b* with reference to FIGS. 5 to 7. In this embodiment, the scanning exposure apparatus is a unit that is detachably mounted on the image forming apparatus.

The scanning exposure apparatus 1*b* is mounted on the image forming apparatus body with the orientation inverse to the scanning exposure apparatus 1*a* with respect to the vertical direction. The scanning exposure apparatus 1*b* performs scanning exposure of the two photosensitive drums disposed below it. The scanning exposure apparatus 1*b* differs from the scanning exposure apparatus 1*a* only in the manner in which the polygon mirror 23, motor 24 and cap 32 are attached to the optical device box 20, and the structure of the scanning exposure apparatus 1*b* other than those mentioned above is the same as the structure of the scanning exposure apparatus 1*a*.

Figure 1:
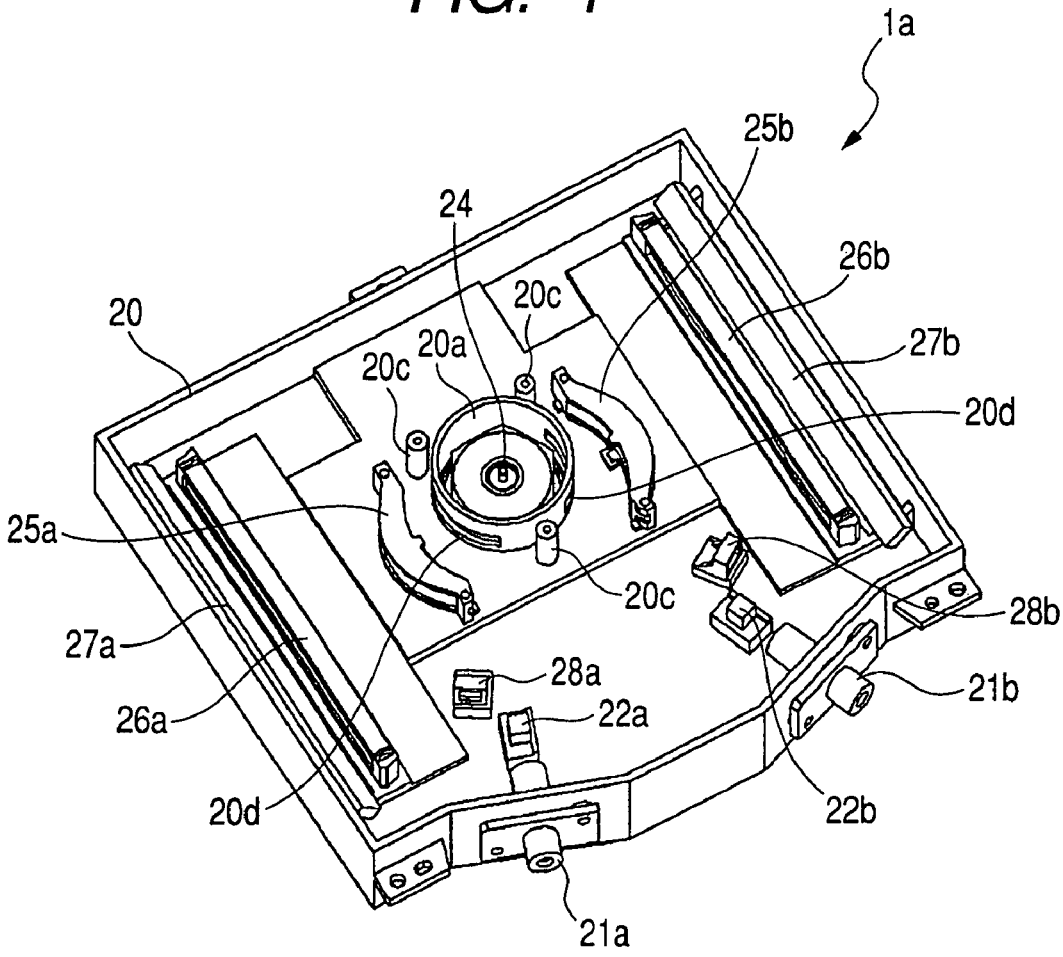
FIG. 1 is a perspective view of a scanning exposure apparatus to which the present invention is applied.
Figure 2:
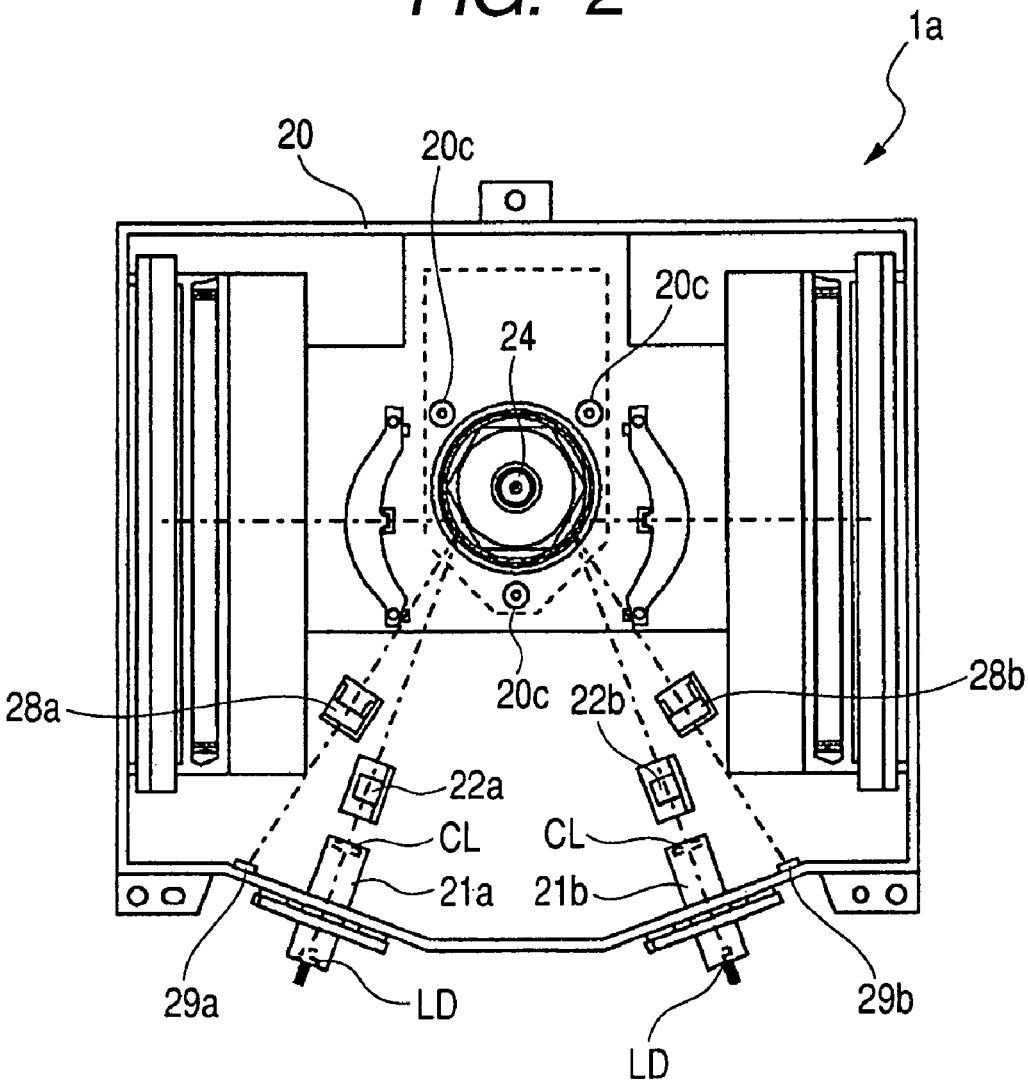
FIG. 2 is a top view of the scanning exposure apparatus shown in FIG. 1.
Figure 6A:
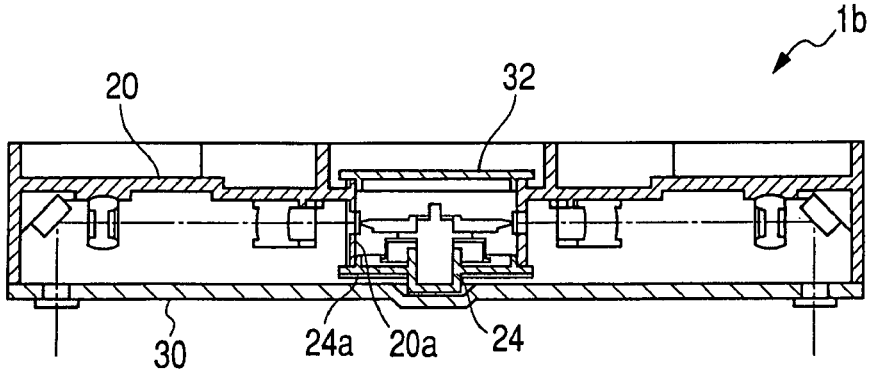
FIG. 6A is a cross sectional view of the scanning exposure apparatus shown in FIG. 5.
Figure 6B:
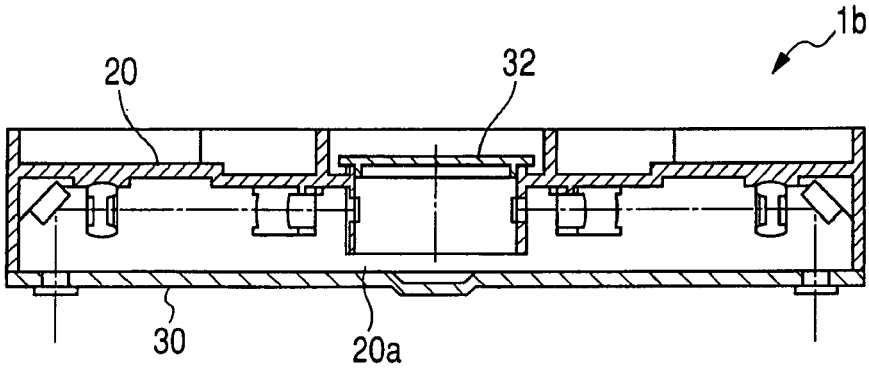
FIG. 6B is a cross sectional view of an optical device box of the scanning exposure apparatus shown in FIG. 5.
Figure 6C:
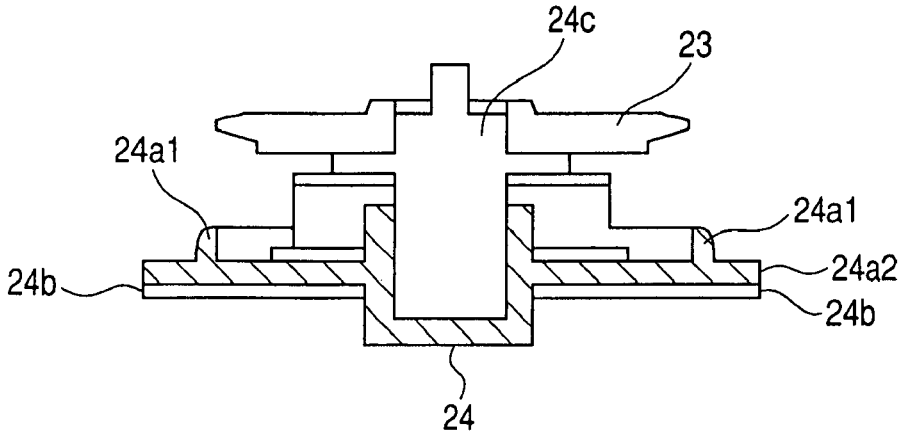
FIG. 6C is a cross sectional view of a motor on which a polygon mirror is attached in the scanning exposure apparatus shown in FIG. 5.

Referring to FIG. 6A to 6C, the motor 24 is fixed to three motor mount portions 20*c* (second mount portions) provided on the inner side of the optical device box 20 from the downward (second direction) of the optical device box 20 (see FIG. 2). Thus, the surface having the lid 30 is facing downward in the image forming apparatus and constitutes the bottom surface of the optical device box 20. The motor 24 is attached from the bottom side. When the motor 24 is attached, the outer circumference of the circular positioning portion (second engagement portion) 24*a*1 that is provided on the stator 24*a*2 of the motor and coaxial with the rotary shaft fits or engages with the inner circumference of the cylindrical positioning portion 20*a* provided on the optical device box 20. In this way, the outer circumference of the positioning portion 24*a*1 of the motor 4 fits with the inner circumference of the positioning portion 20*a* of the optical device box 20, whereby the polygon mirror 23 attached to the rotor 24*c* of the motor 24 is positioned. In connection with this, since the circular positioning portion 24*a*1 fits with the positioning portion 20*a* which has a coaxes with the rotation axis of the polygon mirror and the same inner circumference, comparing to the case of the scanning exposure apparatus 1*a* is mounted, the position of the polygon mirror 23 is positioned in the same position relationship relative to the optical device box. The circular positioning portion 24*a*1 and the cylindrical positioning portion 20*a* constitute the position maintaining mechanism according to the present invention. Thanks to this position maintaining mechanism, the motor 24 can be maintained in the same position irrespective of the orientation of the scanning optical apparatus disposed on the body of the image forming apparatus. The position maintaining mechanism according to the present invention is not limited to the combination of the circular positioning portion 24*a*1 of the motor 24 and the cylindrical positioning portion 20*a* of the optical device box 20 as described above. The positioning portion 24*a*1 may have a different structure provided that it can maintain the motor 24 in the same position even when the optical device box 20 is mounted on the image forming apparatus upside down. With the above feature, the drive axis and the center axis of the positioning portion 24*a*1 are substantially aligned with each other.

As will be seen from FIG. 6A, optical components such as lenses and mirrors are supported on the optical frame on the same side as the cylindrical positioning member 20*a*.

FIG. 6C illustrates the motor 24 having a polygon mirror. The motor 24 is the same as the motor 24 in the exposure apparatus 1*a*. Accordingly, a common type of motors 24 can be used in spite that the directions of the laser emitted from the exposure apparatus 1 and the exposure apparatus 1*b* are opposite.

FIG. 6B illustrates the structure of the frame of the optical device box 20 on which the motor has not been attached. As described before, when the motor 24 is attached, the polygon mirror side of the motor 24 is first inserted into the optical device box.

When the optical device box is mounted on the image forming apparatus, the rotational polygon mirror can be disposed on the upper side of the motor with respect to the vertical direction in the image forming apparatus.

In this embodiment, the first engagement portion and the second engagement portion are integral portion that constitutes the positioning portion. Since the center line of the first engagement portion and the center line of the second engagement portion are substantially aligned with each other, positional variations of the drive axis among optical units can be made small even if the motors are mounted differently on the first fitting portion and second fitting portion.

Although in this embodiment the positioning portion and the base member are integral, the positioning portion may be provided as a positioning member separate from the base member, and the positioning member may be attached to the base member. In this case also, the same advantageous effects can be achieved.

The cap 32 attached to the three motor mount portions 20*b* provided on the outer side of the optical device box 20 can seal the optical device box 20 and prevent dust from entering the optical device box 20.

In the case of the scanning exposure apparatus 1*b*, the motor is mounted upside down relative to the optical device box 20. Accordingly, the polygon mirror 23 rotates in the reverse direction when seen from the photosensitive drum side. However, as described before, the timing of image writing can be controlled by selecting a suitable light sensor among the light sensors 29*a* and 29*b* according to the rotation direction.

Figure 8:
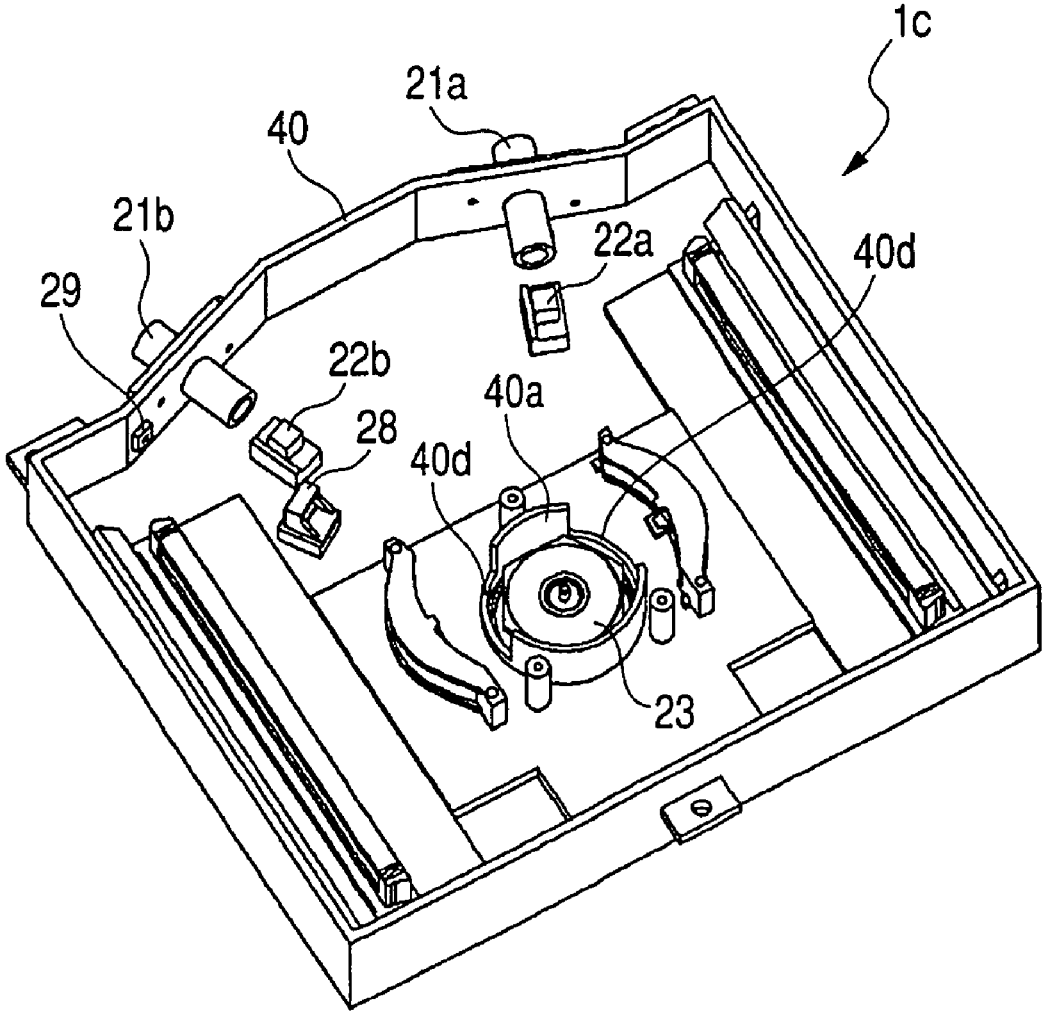
FIG. 8 is a perspective view of another embodiment.

FIG. 8 illustrates a scanning exposure apparatus 1*c* as another embodiment of the scanning exposure apparatus. The scanning exposure apparatus 1*c* differs from the scanning exposure apparatus 1*a* in the structure of the optical device box 40 and the provision of a light sensor 29 for detecting the timing of image writing.

The optical device box 40 has a cylindrical positioning portion 40*a* to which the circular positioning portion 24*a*1 of the motor 24 is to be fitted, in a similar manner as with the optical device box 20 of the scanning exposure apparatus 1*a*. The cylindrical positioning portion 40*a* is molded integrally with the frame of the optical device box 40. The inner diameter of the cylindrical positioning portion 40*a* of the optical device box 40 is larger than the diameter of the circumscribed circle of the polygon mirror 23 and the outer diameter of the rotor of the motor 24. Consequently, the cylindrical positioning portion 40*a* will not interfere with the polygon mirror 23 nor the rotor of the motor 24 when they rotate. The cylindrical positioning portion 40*a* of the optical device box 40 has two cut-away portions 20*d* for allowing the laser beams coming from the laser units 21*a* and 21*b* and the laser beams deflected and scanned by the polygon mirror 23 to pass therethrough. Due to the presence of the cut-away portions 40*d*, the upper portion of the cylindrical positioning portion 40*a* does not form a continuous cylinder, but it can position the circular positioning portion 24*a*1.

The laser beam emitted from the laser unit 21*b* is deflected and scanned by the polygon mirror 23, and a part of the laser beam thus scanned is focused by a lens 28 onto the light sensor 29. With this position of the light sensor, the polygon mirror 23 rotates anticlockwise when seen from the photosensitive drum side. In the case where the motor 24 is mounted upside down on the optical device box 40, the direction of rotation of the motor 24 is reversed, whereby timing of image writing can be controlled.

In the above described embodiment, the image forming apparatus uses a plurality of scanning exposure apparatuses each of which exposes a plurality of photosensitive drums to laser beams that are emitted from a plurality of light sources and deflected and scanned by one polygon mirror. However, it will be easily understood that the present invention can be effectively applied to an image forming apparatus that uses a plurality of scanning exposure apparatuses each of which exposes one photosensitive drum to a laser beam that is emitted from one light source and deflected and scanned by one polygon mirror.

In the above described embodiments, the outer diameter of the positioning portion is designed to be larger than the rotational diameter of the rotational polygon mirror. However, what is required is that the positioning portion can be positioned relative to the optical frame by a stationary portion having a bearing portion, or more preferably, a stationary portion molded integrally with a bearing portion, and the size of the positioning portion is not limited to that of the discloses embodiments.

Although in the above described embodiments the image forming units with the photosensitive drums 7 and 8 are adapted to form light color toner images, the toners used in the image forming units are not limited to them. An image forming unit that forms an image of white toner, transparent toner or other special color toner may also be used.

As per that above, in the image forming apparatus in which the motor is positioned relative to a base member by a bearing member of the motor, precision of scanning by rotation polygon mirrors in the first exposure apparatus that performs exposure from below with respect to the vertical direction and in the second exposure apparatus that performs exposure from above with respect to the vertical direction can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-147381, filed May 26, 2006 which is hereby incorporated by reference herein in its entirety.

What is claimed is:

1. A light scanning apparatus comprising:

a rotational polygon minor that deflects a light emitted from a light source;

a supporting unit that supports the rotational polygon mirror; and a frame that holds the supporting unit, the frame having a first surface and a second surface opposite the first surface, wherein the supporting unit is positionable on the frame with regard to the rotational polygon mirror at a side of the first surface or a side of the second surface, wherein the frame includes a first engagement portion with which the supporting unit engages in a case where the supporting unit is positioned with regard to the rotational polygon mirror at the side of the first surface, and a second engagement portion with which the supporting unit engages in a case where the supporting unit is positioned with regard to the rotational polygon minor at the side of the second surface.

2. A light scanning apparatus according to claim 1, wherein the first engagement portion and the second engagement portion are circular in shape, and the center axis of the first engagement portion and the center axis of the second engagement portion are substantially aligned with each other.

3. A light scanning apparatus according to claim 2, wherein the supporting unit supports a bearing portion of a rotary shaft that rotates the rotational polygon mirror, and engages with the first engagement portion so as to substantially correspond a rotation axial line of the rotary shaft to a center axial line of the first engagement portion.

4. A light scanning apparatus according to claim 3, wherein the supporting unit supports a bearing portion of a rotary shaft that rotates the rotational polygon minor, and engages with the second engagement portion so as to substantially correspond a rotation axial line of the rotary shaft to a center axial line of the second engagement portion.

5. A light scanning apparatus according to claim 1, wherein the first engagement portion and the second engagement portion has have a cylindrical shape.

6. A light scanning apparatus according to claim 1, further comprising an optical lens provided on the frame so that a light beam deflected by the rotational polygon mirror passes through the optical lens in a case of positioning by engaging the supporting unit into the first engagement portion, and a light beam deflected by the rotational polygon minor passes through the optical lens in a case of positioning by engaging the supporting unit into the second engagement portion.

7. A light scanning apparatus according to claim 1, wherein the frame includes an aperture positioned between the first engagement portion and the second engagement portion, wherein the position of the aperture is such to allow a light beam deflected by the rotational polygon minor to pass through the frame when the supporting unit is positioned with regard to the rotational polygon mirror at the side of the first surface, and to allow a light beam deflected by the rotational polygon minor to pass through the frame when the supporting unit is positioned with regard to the rotational polygon mirror at the side of the second surface.

8. A light scanning apparatus according to claim 1, wherein the frame includes a cut-away portion, wherein the position of the cut-away portion is such to allow a light beam deflected by the rotational polygon mirror to pass through the frame when the supporting unit is positioned with regard to the rotational polygon mirror at the side of the first surface, and to allow a light beam deflected by the rotational polygon minor to pass through the frame when the supporting unit is positioned with regard to the rotational polygon mirror at the side of the second surface.

* * * * *